US005979942A

United States Patent [19]

Ivicic

[11] Patent Number: 5,979,942

[45] **Date of Patent: *Nov. 9, 1999**

[54] MECHANICAL GREETING CARD

[76] Inventor: Zivko G. Ivicic, 141 Shadyside Rd., Ramsey, N.J. 07446

[ * ] Notice: This patent issued on a continued prosecution application filed under 37 CFR 1.53(d), and is subject to the twenty year patent term provisions of 35 U.S.C. 154(a)(2).

[21] Appl. No.: 08/608,463

[22] Filed: Feb. 28, 1996

[51] Int. Cl.[6] ..... B42D 15/00

[52] U.S. Cl. ..... 283/117; 40/124.1; 283/64; 281/29

[58] Field of Search ..... 281/22, 38, 36, 281/29, 51; 283/117, 64; 412/57; 40/124.1

*Primary Examiner*—Willmon Fridie, Jr.

*Attorney, Agent, or Firm*—Levisohn, Lerner, Berger & Langsam

[57] ABSTRACT

A novel greeting card is disclosed having metallic leaves secured with one or more mechanical hinges. Various forms of engravings, hinges, leaves and overlays may be provided. Interior leaves may be inserted as well. The greeting card constitutes a permanent or semi-permanent commemoration of a special occasion or event.

36 Claims, 5 Drawing Sheets

MY VALENTINE
10
12
14
16
18
19
20
21
24
28

FIG.4a
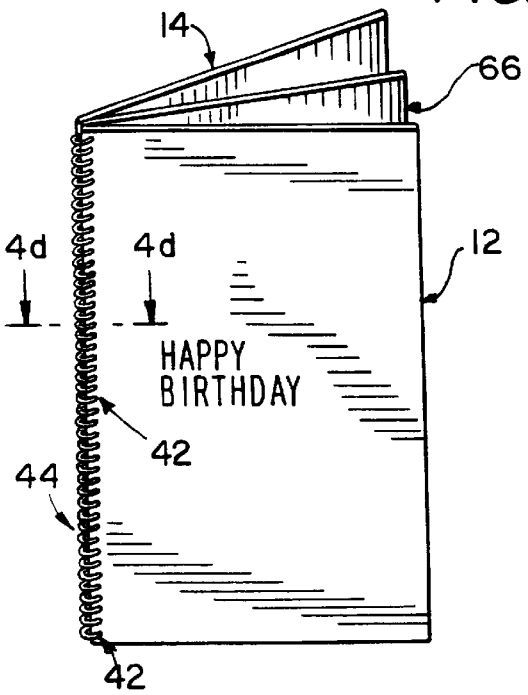
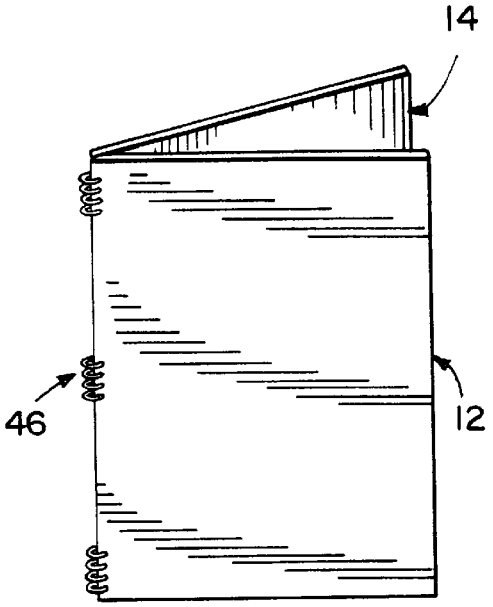
FIG.4b
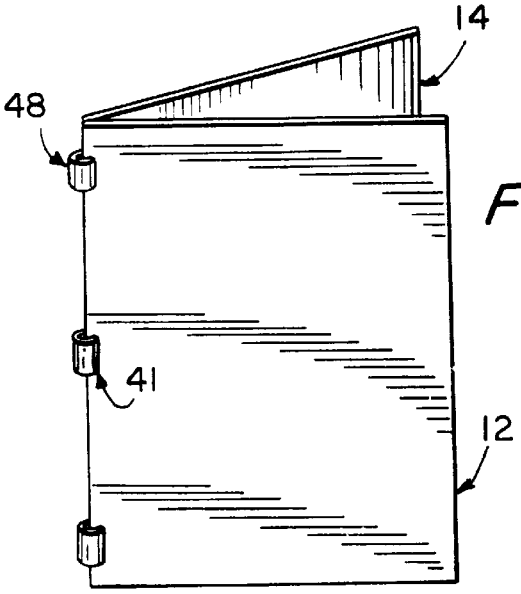
FIG.4c
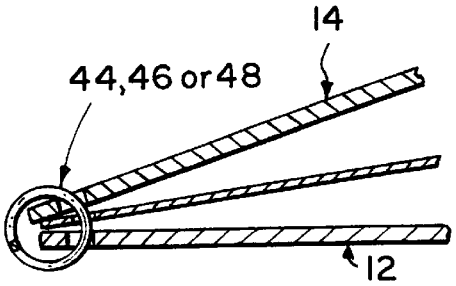
FIG.4d

MECHANICAL GREETING CARD

BACKGROUND AND FIELD OF THE INVENTION

Most people have, at some time in their life, purchased or received a greeting card. Such cards are often given to celebrate milestones in a person's life, such as birthdays and anniversaries, or to commemorate important events such as graduations, religious holidays, or the death of a loved one. Cards are, in short, a common and well-liked means of expressing an appropriate sentiment to a friend, relative or colleague on an important occasion.

Recently, many new forms of greeting cards have been proposed and introduced into the art. For example, U.S. Pat. No. 5,435,085, discloses a greeting card device comprised of a pair of foldable panels with an inner foldable receptacle capable of holding water for a living plant. The card combines the common practice of bestowing flowers on special occasions with the practice of sending a card. The greeting card is intended to be discarded within a few days of receipt.

U.S. Pat. No. 5,338,241 discloses a packaged balloon and greeting card combination. An uninflated balloon with an image printed thereon is provided with a greeting card having a face displaying an image corresponding to the image on the balloon. A separate envelope may also bear an imprint of the same image. The greeting card and the envelope serve as a protective cover for the balloon during shipment, storage and display. The balloon and greeting card are packaged together as a unit.

U.S. Pat. No. 5,375,351 discloses a greeting card having a magnetic picture frame temporarily attached to the card's surface with a releasable adhesive. The frame can hold a picture on the front of the card that can be removed from the card and magnetically attached to a ferrous metal surface such as a refrigerator.

Notwithstanding the numerous new and unusual embodiments that have been developed, the traditional greeting card has remained relatively unchanged over the years. Although they may vary in size, greeting cards uniformly consist of one or more folded sheets of paperboard or paper stock material. An appropriate sentiment or illustration is printed on either the inside or outside of the card, or both.

Despite the importance that many persons attach to giving and receiving greeting cards, and the fact that they are often sent to commemorate important occasions, such cards generally do not last very long, and are, in fact, made of disposable materials. Thus, after prolonged display, use or storage, greeting cards tend to warp, sag, tear, or yellow and deteriorate with age. This is particularly unfortunate since some cards may be important enough to the recipient that he or she wishes to save them for many years to come.

Accordingly, there is a need in the art for a durable, long lasting greeting card which can be saved and displayed after receipt for an extended period, beyond the lifespan of the traditional paper greeting card. Moreover, consumers are always interested in new and interesting ways of sending gifts or holiday sentiments.

There is also a need and interest in the industry for a new, improved form of greeting card, having novel features which enhance or improve their impact on a recipient.

SUMMARY AND OBJECTS OF THE INVENTION

An object of the present invention is to provide a novel, long lasting, mechanical greeting card which can be displayed or stored for an extended period of time without deterioration.

A further object of the present invention is to provide a greeting card which can be engraved in the manner of fine jewelry.

A further object of the present invention is to provide a greeting card having a highly lustrous and polished finish.

A further object of the present invention is to provide a greeting card which can be displayed like an item of sculpture.

The present objects are accomplished by providing an improved type of greeting card fabricated out of metallic materials. Metallic sheets of elements or alloys such as gold, silver, copper or bronze are fabricated into leaves of predetermined, visually attractive shapes. The metallic sheets are then fastened together with hinges into a metallic greeting card structure. The metallic structure can be engraved, polished, or similarly treated to further enhance the appearance of the greeting card thereby created. In a further embodiment, the improved greeting card is fastened with hinges, but fabricated out of an alternative, durable material, such as plastic, ceramic, or the like.

BRIEF DESCRIPTION OF THE DRAWINGS

FIG. 4*a* is a front and top perspective view of a greeting card with hinges in the form of a spiral connector.

FIG. 4*b* is a front and top perspective view of a greeting card with multiple spiral connectors.

FIG. 4*c* is a front and top perspective view of a greeting card with multiple cylindrical connectors.

FIG. 4*d* is a top plan view of the partially opened greeting cards of 4*a–c* with connector(s). The connector used may be one or more spiral or cylindrical connectors, as shown in FIGS. 4*a–c*. An optional inner leaf is shown, as well.

DETAILED DESCRIPTION OF THE DRAWINGS AND THE PREFERRED EMBODIMENTS

As shown in FIG. 1, a novel greeting card is disclosed in accordance with the present invention. Greeting card 10 has a front leaf 12 and a back leaf 14. Leaves 12 and 14 are constructed out of a metallic element or alloy such as copper, bronze, silver, gold, platinum, steel, or so forth. Inexpensive or precious metals can be employed.

Front leaf 12 presents a front face 16 which is visible when the card is closed. This front face 16 may be engraved with an appropriate sentiment or message, an illustration or artistic drawing, or both. Front face 16, therefore, can be engraved with a caption such as "Happy Anniversary", "Merry Christmas", "My Valentine", or the like. Similarly, it can be provided with an engraved border around the message or with another desired illustration. In place of engraving, appropriate words and/or illustrations may be painted on the front face, using enamel or other suitable material.

Figures 1A, 1B, 1C:
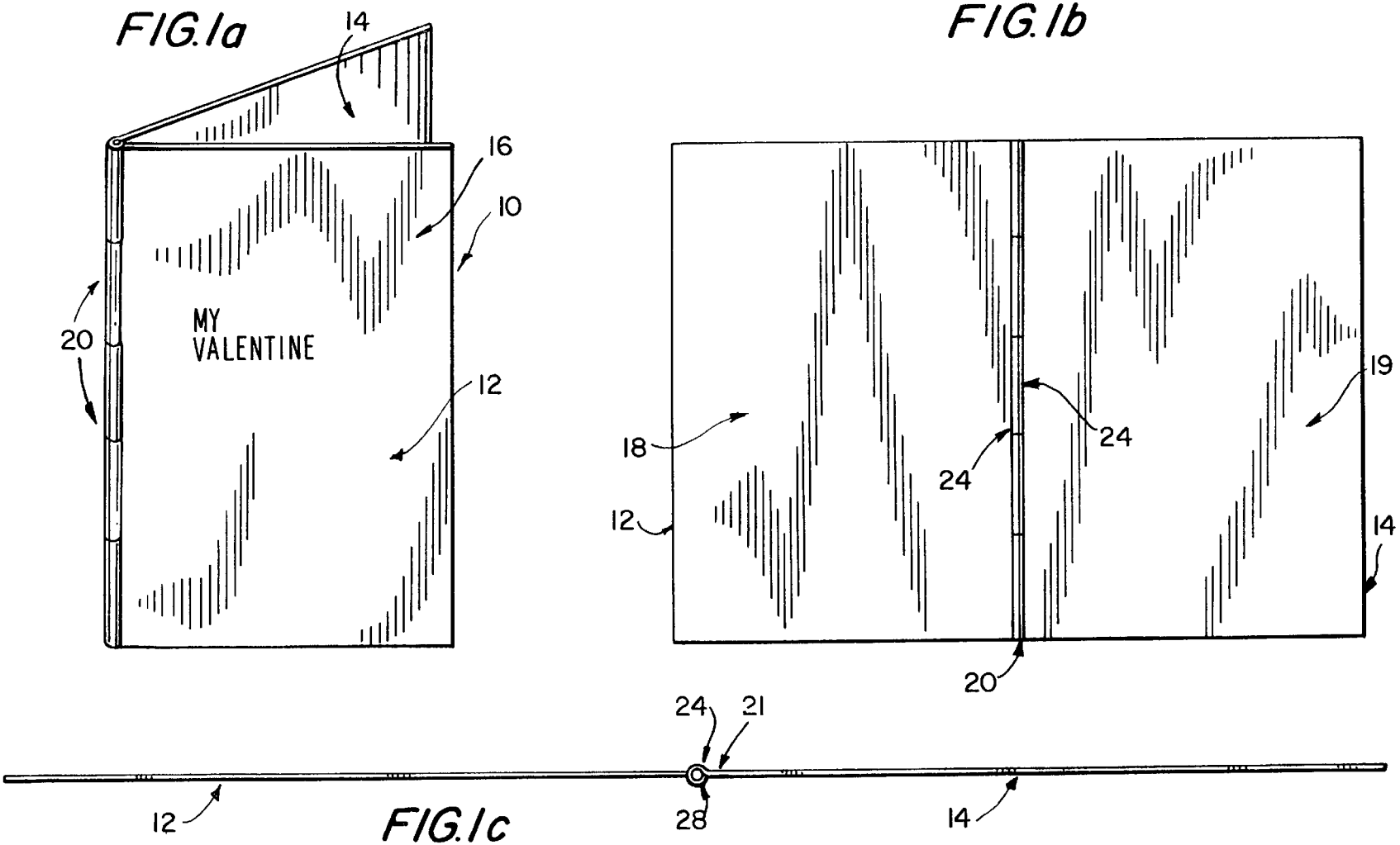
FIG. 1*a* is a front and top perspective view of a greeting card in accordance with the present invention, showing the card's leaves secured by hinges.
FIG. 1*b* is a front view of the greeting card of FIG. 1*a*, in an open position (i.e. with the leaves at a 180 degree angle), and with the inner faces being shown. The obverse view (i.e. the view of the card in an open position with the outer faces of the card showing), although not shown, is preferably identical to that of FIG. 1*b*. Thus, in the obverse view, the shape of the leaves and the interleaved knuckles is the same as shown in FIG. 1*b*. The words or illustrations displayed on the inside and outside of the card, however, may, differ between FIG. 1*b* and its obverse view, if desired.
FIG. 1*c* is a top view of the open greeting card of FIG. 1*b*.

When opened, as shown in FIG. 1*b*, front leaf 12 and back leaf 14 of greeting card 10 present opposing inner faces 18 and 19, respectively. As with the front face of the card, a wide variety of expressions and illustrations may be engraved or painted on the inner faces (and even the back face of leaf 14) of greeting card 10.

Front leaf 12 and back leaf 14 are secured to each other by mechanical hinges 20. Numerous different types of hinges may be used. For example, as shown in FIG. 1*b* and 1*c*, a set of knuckles 24 protrude from front leaf 12 and back leaf 14 to form hinges 20. Each knuckle 24 is a curved extension extending from the flat surface 21. Each extension forms a hollow tube. The knuckles 24 on each of the leaves are complementary such that when front leaf 12 is placed adjacent to back leaf 14 (or alternately, when one leaf is placed directly over the other), the knuckles interleave as shown in the Figure. When interleaved, the knuckles 24 of hinges 20 cooperate such that the hollow tubular knuckles 24 align to create a cylindrical opening or tubular shaft extending through the series of knuckles. A cylindrical member or pin 28 is then inserted through this cylindrical opening or tubular shaft created by the interleaved knuckles to form a secure joint. Upon insertion of the pin 28, hinge 20 secures leaves 12 and 14, allowing the leaves to swing open and closed.

Figure 2A:
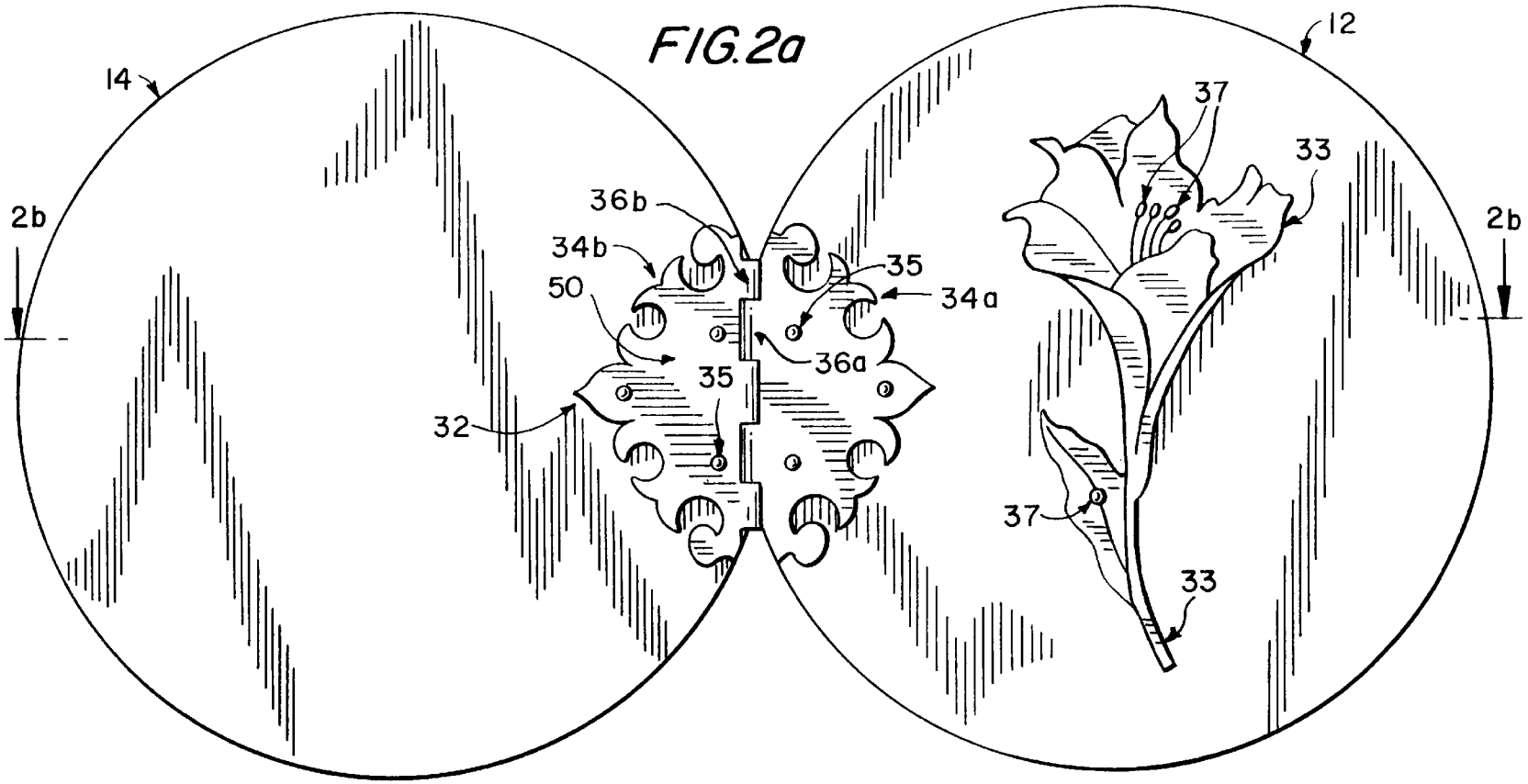
FIG. 2*a* is a front view of a circular greeting card in an open position, and with the outer faces being shown. The obverse view (not shown) is a view of the card in an open position, with the inner faces of the card shown. The obverse view shows leaves of identical shape as those in FIG. 2*a*, although the flower overlay is preferably removed. In addition, in the obverse view the interleaved knuckles are visible, but not the plates 34*a* and 34*b* (which are affixed to one side of the card).
Figure 2B:
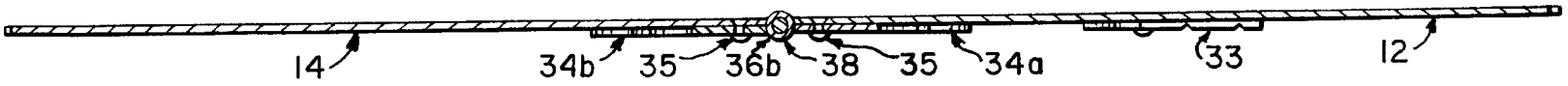
FIG. 2*b* is a top plan view of the circular greeting card of FIG. 2*a*.

A second example of a suitable hinge is shown in FIGS. 2*a*–*b*. Hinge 32 consists of opposing plates 34*a* and 34*b*. Plate 34*a* is secured to the outside of front leaf 12, and plate 34*b* is secured to the outside of back leaf 14. The plates can be secured to the leaf with small studs, pins or screws 35, or by any other suitable means. (It is preferable that the bottom of the studs 35, which protrude through the leaf to the opposing side, be flush with that opposing side, for improved appearance.) Knuckles 36*a* and 36*b*, of opposing plates 34*a* and 34*b*, respectively, interleave to form an aligned cylindrical opening in a manner analogous to that shown in previous FIGS. 1*a*–1*c*. A pin 38 can then be inserted through the interleaved knuckles, allowing leaves 12 and 14 to swing open and closed.

Plates 34*a* and 34*b* may be one of any number of styles. As shown in FIGS. 2 and 3, the plates 34 may be fashioned into any one of a number of decorative shapes. Alternatively, the plates can be rectangular. The studs 35 may either be of the same or different metal composition or color as the plates 34. The plates may likewise be of the same or different metal composition or color as the leaves 12 and 14.

In another embodiment of the present invention, the hinge used for securing leaves 12 and 14, constitutes a connecting member, as shown in FIGS. 4*a*–*d*. The connecting member may be a spiral connector 44, as shown in FIG. 4*a*, a cylindrical connector 48 as shown in FIG. 4*c*, or the like.

As shown in FIGS. 4*a*–4*b*, leaves 12 and 14 are each provided with a plurality of holes 42. Spiral connector 44 is a spiral length of wire-like material extending through holes 42 to connect leaves 12 and 14 in a manner analogous to that of a spiral notebook. Spiral connector 44 can constitute a single continuous length of material extending along the entire edge of leaves 12 and 14, or a plurality of spiral connectors 46 can be placed along the greeting card's edge.

Alternatively, a plurality of cylindrical connectors 48 can be used as shown in FIG. 4*c*. Cylindrical connector 48 is a cylindrical or tube-like ring extending through slits 40 to secure the leaves of the greeting card. As with the spiral connector 44, a single cylindrical connector 48 or a plurality of cylindrical connectors may be employed.

In addition to the above forms of hinges, it will be appreciated that other type of hinges can be employed, as well, from the many different types of hinges well known in the art. Moreover, instead of fabricating the hinges from metal, other durable materials may be utilized, although metal is preferred.

Leaves 12 and 14 may both be fabricated out of materials that are of the same or different compositions or colors. Although material of the same composition and color will often be employed, use of different compositions or colors is occasionally desirable to provide an attractive contrast.

Although leaves 12 and 14 have been shown as rectangular sheets of metallic composition, it will be appreciated that other shapes can be employed as well. As shown in FIG. 2, for example, leaves 12 and 14 can be made of substantially circular sheets of material. A small straight edge 50 is preferably provided on one side of each of the substantially circular sheets, for easy connection of a hinge. Similarly, as shown in FIG. 3, leaves 12 and 14 can each be heart-shaped, which is particularly appropriate for greeting cards sent on Valentine's Day or other romantic occasions. Other desired shapes can likewise be utilized, with the edges of the leaves being straight or curved in shape.

Figure 3A:
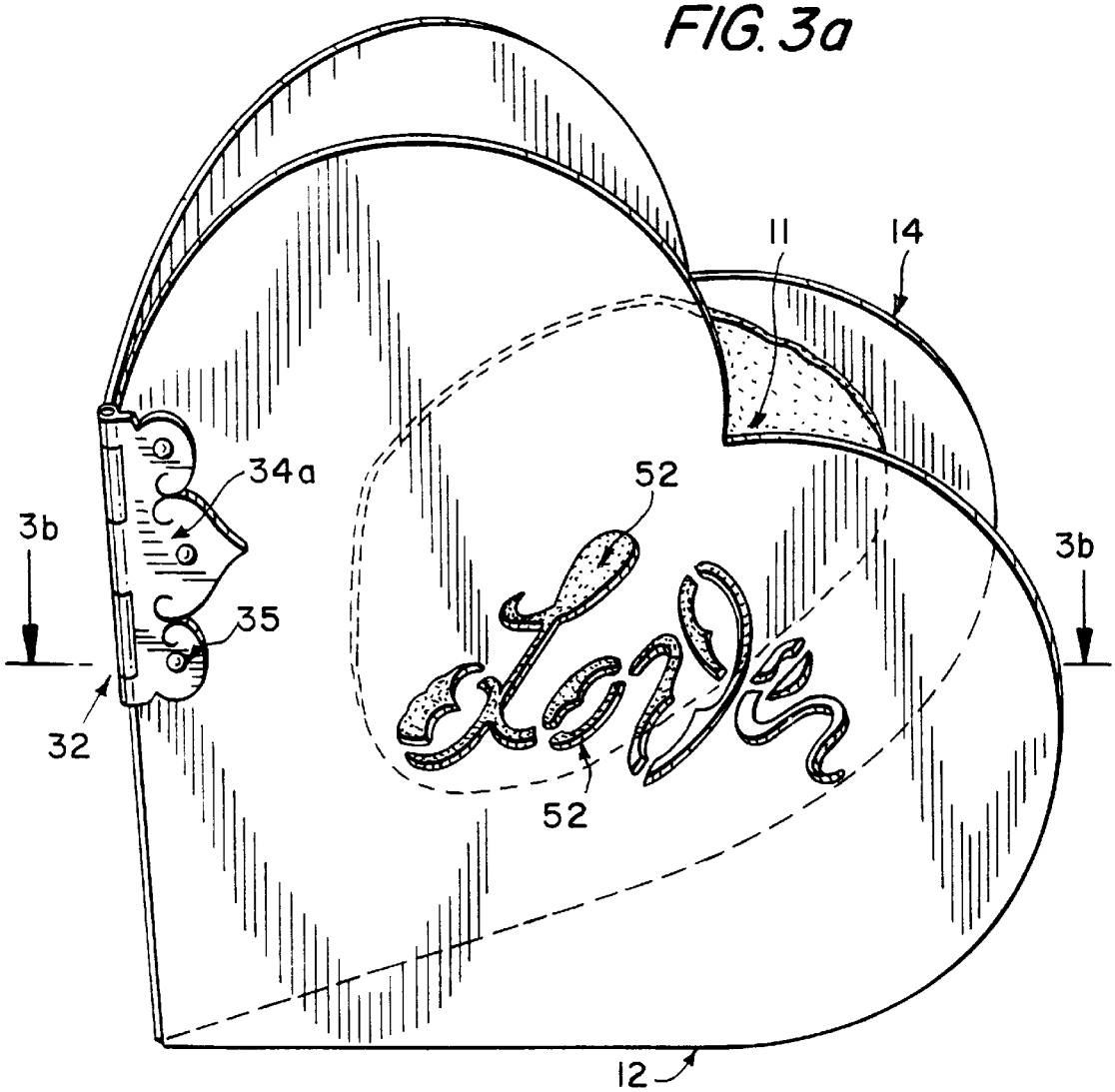
FIG. 3*a* is a front and top perspective view of a heart-shaped greeting card in a partially opened position with the outer face of the front leaf, and a portion of the inner surface of the back leaf, being shown.
Figure 3B:
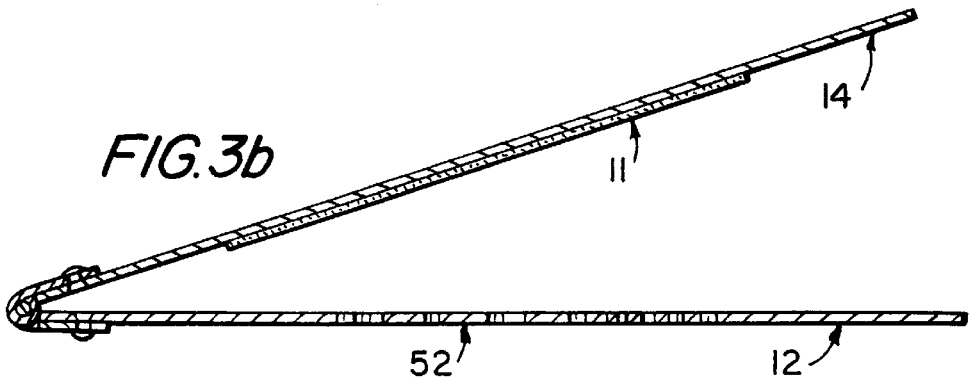
FIG. 3*b* is a top plan view of the partially opened heart-shaped greeting card of FIG. 3*a*.

The leaves may also be provided with slits or windows extending through their surface. As shown in FIGS. 3*a* and 3*b*, front leaf 12 is provided with a slit 52 on the face of the greeting card. This slit or window 52 provides a view through the front leaf 12 of a portion of the inner surface of the back leaf 14, when the card is closed. Since the figure, for example, shows a heart-shaped card for Valentine's Day, the slit or window 52 is provided in the shape of the word "Love". The inner surface of back leaf 14, or a portion 11 thereof, can be colored differently than the outer surface of front leaf 12, if desired. This creates a contrast in color between the color showing through the slit or window (making the word "Love" on the outer surface of front leaf 12 of the card), and the color of the remainder of the outer surface of the front leaf 12. The slit or window 52 can be in the shape or a word, or an illustration, or both.

In addition to or instead of cutting a slit in the face of a leg of the card, an edge of the card can be recessed or cut-out, as shown in FIG. 5. As shown in the Figure, the name of a person (Regina) is cut out to illustrate a birthday card in that person's honor. Alternatively, any other word or type of design can be cut out of the edge of the card.

Overlays of metal or another suitable material can also be placed on any of the leaves of the card. As shown in FIG. 2, a flower shaped metal overlay 33 is placed atop the front surface of front leaf 12. The overlay 33 is secured to the front surface by small pins or screws 37 or by adhesive. The pins or screws are preferably flush with the top surface of the overlay and the bottom surfaces of the leaf for improved appearance.

In addition to the front and back leaves 12 and 14, one or more additional interior leaves 66 can also be provided. Numerous means can be provided for securing the interior leaves to the card. Knuckles can be provided on a side edge of each interior leaf, with the knuckles on the interior leaves interleaving with those on front and back leaves 12 and 14. Or, holes or slits can be provided on the edge of the interior leaves, for insertion of a spiral connector or cylindrical connector. Alternatively, the interleaving knuckles of the front and back leaves can have spacings provided therein for insertion of rectangular fasteners 62. The rectangular fasteners 62 can be attached to a metal leaf or a sheet of paper to secure it between the front and back leaves 12 and 14. A third leaf can also be provided as a hinged leaf to the back leaf, yet folded inside of the front and back leaf, when the card is closed.

Figure 5A:
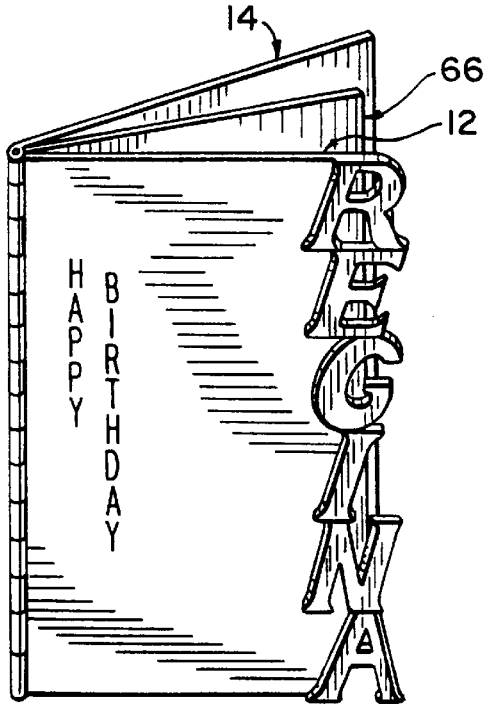
FIG. 5*a* is a front and top perspective view of a greeting card showing a front leaf with a recessed right edge. An inner leaf is shown, as well.
Figure 5B:
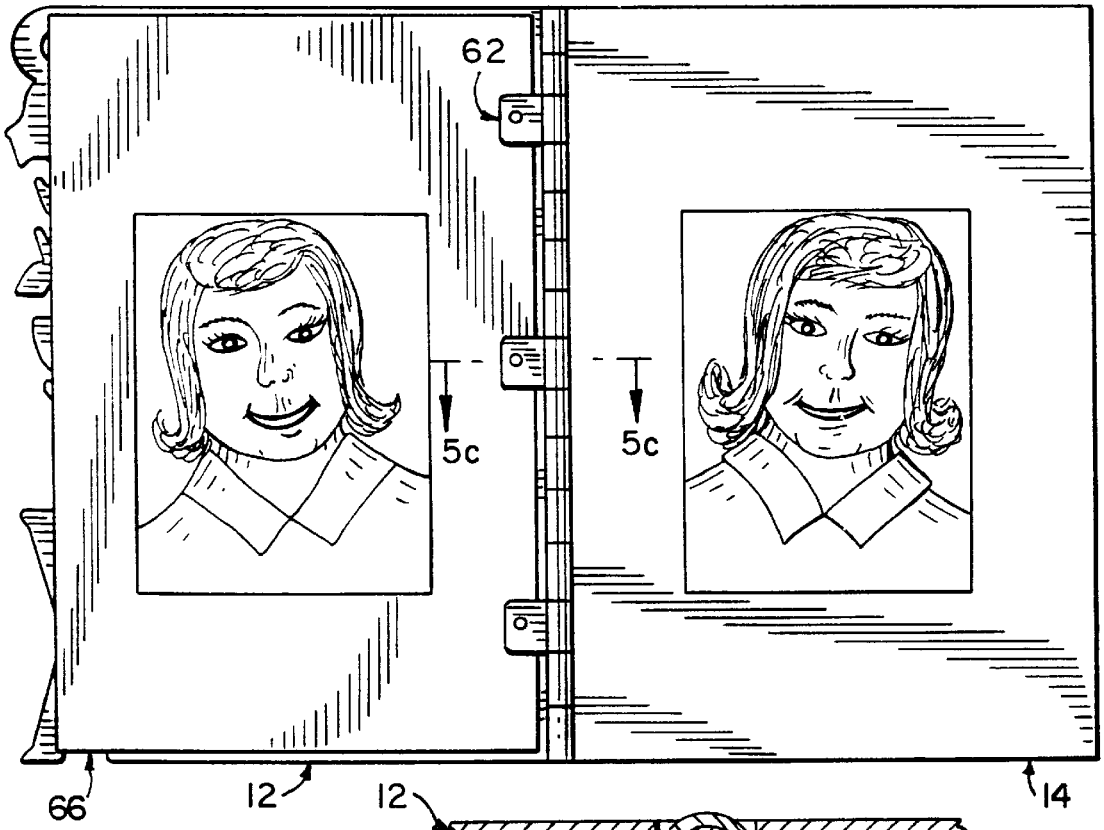
FIG. 5*b* is a front view of the greeting card of FIG. 5*a* in an open position, showing interior faces of the front and back leaves, and showing an interior leaf fastened with rectangular fasteners. Images are placed on the facing sides of the interior leaves for an attractive effect.
Figure 5C:
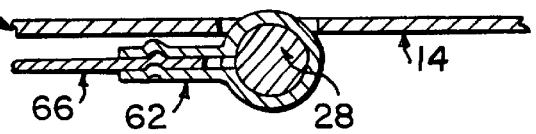
FIG. 5*c* is a cross-sectional view of FIG. 5*b*, showing the rectangular fasteners attached to the greeting card's hinge.

Thus in FIGS. 5*a–c*, which depict a birthday card, rectangular fasteners 62 secure an interior paper leaf 66 having an image of an individual thereon between front and back leaves 12 and 14. The interior leaf (or leaves) can, of course, be made of any other suitable material as well, such as metal, plastic, etc. As a further aspect of the invention, the interior surface of the leaves facing the printed image has a corresponding image of the individual engraved thereon. In like manner, the printed image on an interior leaf and the facing engraved image on the front or back leaf can be similar or contrasting to achieve a novel effect. In the figure, the recipient "Regina" whose birthday it is, is shown.

Alternatively, any other image or combination of images can be used. For example a baby announcement can face a picture of a baby, or so forth.

In addition, when one or more of the leaves are made of a different size, a novel effect can be achieved as well. As shown in FIG. 5, the interior leaf is of slightly smaller width than the front and back leaves so that the engraved cut-out at the edge of front leaf overlaps with the interior leaf, which partially overlaps with the back leaf, contributing to the novel look of the card. Making the size of the front leaf smaller than that of the back leaf can also make it easier to open the card.

The various embodiments of the present invention thus produce a durable, attractive, and novel greeting card, which can be crafted out of any one of a number of metals, almost like an item of sculpture. The card is less likely to deteriorate, and more likely to be treated as a permanent gift than the disposable cards currently used in the art. Thus, rather than being kept by the recipient for several days or weeks, it may be displayed and saved for many years as a permanent reminder and keepsake of special events.

Although metal is the preferred material for the leaves of the present mechanical greeting card, it is contemplated that other durable materials such as plastic, ceramic, or the like, may be utilized as well. These materials are fastened with hinges, in a manner analogous to those of FIGS. 1–5, to form a mechanical greeting card structure.

In any of the above described, embodiments, a writing instrument may be included with the card, to allow the sender to write a personalized message on the card before giving it to the recipient. For example, when the card is made of metal, a pen may be provided which is filled with an ink suitable for writing on that metal. Or, a pen may be provided with a sharp metallic, or diamond pointed tip, or the like, to allow the user to engrave or inscribe a message on the metal.

Similarly, any of the implements commonly used by jewelers or engravers can be used to inscribe a message on the greeting card, when the card is made of metal. If desired, one of these implements may be provided with the card, so that the sender can write on the card him or herself. Alternatively, the card can be engraved by a jeweler or engraver with the desired message.

If the card is made of another material other than metal (e.g. plastic, ceramic, etc), a pen suitable for writing or inscribing on that material may be provided, if desired.

Having described this invention with regard to specific embodiments, it is to be understood that the description is not meant as a limitation, for further variations or modifications may be apparent or may suggest themselves to those skilled in the art. It is intended that the present application cover such variations and modifications as fall within the scope of the appended claims.

What is claimed is:

1. A greeting card comprising at least two leaves, a first leaf and a second leaf, wherein at least one of said two leaves is partially formed out of metal, at least one of said leaves having words for communication of a desired message from a sender to a recipient located thereon, and at least one mechanical hinge said mechanical hinge connecting said two leaves wherein said first leaf and said second leaf have surfaces facing each other, wherein said mechanical hinge connecting said surfaces of said first leaf and said second leaf which face each other permit said surfaces to substantially touch each other over the entirety of their surfaces thereby providing a substantially flat greeting card comprising said first and second leaves.

2. A greeting card as claimed in claim 2, wherein at least one of said two leaves is entirely formed out of metal.

3. A greeting card as claimed in claim 1, wherein said first leaf and said second leaf are both entirely formed from metal.

4. A greeting card as claimed in claim 2, wherein knuckles extend from each leaf to form tubular extensions that are interleaved to form a tubular shaft, and wherein said hinge comprises said interleaved knuckles secured with a pin passing through said tubular shaft.

5. A greeting card as claimed in claim 1, wherein each of said hinges comprises two plates, a first plate and a second plate, said first plate being secured to said front leaf and said second plate being secured to said back leaf, each of said plates having knuckles extending therefrom, said knuckles of said plates being interleaved to form a tubular shaft, said tubular shaft having a pin passing therethrough.

6. A greeting card as claimed in claim 5, wherein said plates are rectangular in shape.

7. A greeting card as claimed in claim 5, wherein said plates are non-rectangular in shape.

8. A greeting card as claimed in claim 1, wherein said hinge comprises at least one spiral connector, and wherein said front leaf and said back leaf each has holes provided therein, said spiral connector being threaded through said holes in said front leaf and said back leaf to connect said front leaf and said back leaf together.

9. A greeting card as claimed in claim 1, wherein said hinge comprises at least one cylindrical connector, and wherein said front leaf and said back leaf each has at least one slit therein, said cylindrical connector being threaded through said slits in said front leaf and said back leaf to connect said front leaf and said back leaf together.

10. A greeting card as claimed in claim 1, further comprising at least one interior leaf placed between said first leaf and said second leaf, wherein said one interior leaf has front and back surfaces which are in substantial communication with the facing surfaces of said first and said second leaves to provide a substantially flat greeting card comprising one interior leaf and said first and second leaf.

11. A greeting card as claimed in claim 10, wherein said interior leaf is secured to said first leaf and said second leaf with a fastener.

12. A greeting card as claimed in claim 10, wherein said hinge comprises at least one spiral connector, and wherein said front leaf, said back leaf and said interior leaf are each provided with holes, said spiral connector securing said interior leaf to said first leaf and said second leaf, said spiral connector being threaded through said holes in said first leaf, said interior leaf, and said second leaf.

13. A greeting card as claimed in claim 10, wherein said hinge comprises at least one cylindrical connector, and wherein said first leaf and said second leaf and said interior leaf are each provided with slits, said cylindrical connector securing said interior leaf to said front first leaf and said second leaf, said cylindrical connector being threaded through said slits in said first leaf, said interior leaf, and said second leaf.

14. A greeting card as claimed in claim 10, wherein said interior leaf has knuckles extending therefrom, said knuckles interleaving with a first set of knuckles of said first leaf and a second set of knuckles of said second leaf, said greeting card having a pin extending through said knuckles of said interior leaf and through said first set of knuckles and through said second set of knuckles to form a hinge which secures said first leaf, said interior leaf and said second leaf together.

15. A greeting card as claimed in claim 10, wherein said interior leaf is made of metal.

16. A greeting card as claimed in claim 10, wherein said interior leaf is made of paper.

17. A greeting card as claimed in claim 1, further comprising a metallic overlay on at least one of said two leaves.

18. A greeting card as claimed in claim 2, wherein said first leaf and said second leaf are each formed from the same metal.

19. A greeting card as claimed in claim 2, wherein said first leaf and said second leaf are each formed from different metals.

20. A greeting card as claimed in claim 1, wherein at least one of said two leaves has a window provided therein.

21. A greeting card as claimed in claim 20, wherein said window is in the shape of at least one word.

22. A greeting card as claimed in claim 1, wherein at least one of said two leaves has engravings thereon.

23. A greeting card as claimed in claim 1, wherein at least one of said two leaves is substantially in the shape of a circle.

24. A greeting card as claimed in claim 1, wherein at least one of said two leaves is substantially in the shape of a heart.

25. A greeting card as claimed in claim 10, wherein said interior leaf is smaller than said back leaf.

26. A greeting card as claimed in claim 1, wherein the edge of at least one of said two leaves is curved in shape.

27. A greeting card as claimed in claim 1, wherein said card is further provided with a writing instrument.

28. A greeting card as claimed in claim 2, wherein at least one of said leaves is provided with a cutout on its side.

29. A greeting card as claimed in claim 1, wherein said words commemorate a specific occasion.

30. A greeting card as claimed in claim 2, wherein at least one of said leaves comprises a precious metal.

31. A greeting card as claimed in claim 2, wherein said metal comprises gold.

32. A greeting card as claimed in claim 2, wherein said metal comprises silver.

33. A greeting card as claimed in claim 2, wherein said metal comprises copper.

34. A greeting card as claimed in claim 2, wherein said metal comprises platinum.

35. A greeting card as claimed in claim 2, wherein said metal comprises bronze.

36. A greeting card as claimed in claim 2, wherein said words are engraved on said greeting card.

* * * * *